US009430943B2

(12) United States Patent
McDowell et al.

(10) Patent No.: US 9,430,943 B2
(45) Date of Patent: Aug. 30, 2016

(54) APPARATUS AND METHODS FOR PROVIDING ILLUMINATED SIGNALS FROM A SUPPORT SURFACE

(71) Applicant: NEWPARK MATS & INTEGRATED SERVICES LLC, The Woodlands, TX (US)

(72) Inventors: James Kerwin McDowell, Lafayette, LA (US); Donald Scott Rogers, Lafayette, LA (US); Grant Steven Cavalier, Lafayette, LA (US)

(73) Assignee: Newpark Mats & Integrated Services LLC, The Woodlands, TX (US)

( * ) Notice: Subject to any disclaimer, the term of this patent is extended or adjusted under 35 U.S.C. 154(b) by 237 days.

(21) Appl. No.: 14/336,163

(22) Filed: Jul. 21, 2014

(65) Prior Publication Data

US 2015/0029040 A1 Jan. 29, 2015

Related U.S. Application Data

(60) Provisional application No. 61/857,474, filed on Jul. 23, 2013.

(51) Int. Cl.

| | |
|---|---|
| ***G08G 1/095*** | (2006.01) |
| ***G08G 1/07*** | (2006.01) |
| ***G08B 5/36*** | (2006.01) |
| ***E01C 9/08*** | (2006.01) |
| ***F21S 9/02*** | (2006.01) |
| *F21S 9/03* | (2006.01) |
| *F21V 15/01* | (2006.01) |
| *F21W 111/00* | (2006.01) |
| *F21Y 101/02* | (2006.01) |
| *F21Y 113/00* | (2016.01) |
| *F21V 23/04* | (2006.01) |

(52) U.S. Cl.
CPC . *G08G 1/07* (2013.01); *E01C 9/08* (2013.01); *F21S 9/02* (2013.01); *G08B 5/36* (2013.01); *F21S 9/037* (2013.01); *F21V 15/01* (2013.01); *F21V 23/045* (2013.01); *F21W 2111/00* (2013.01); *F21Y 2101/02* (2013.01); *F21Y 2113/005* (2013.01)

(58) Field of Classification Search
CPC ..... G08G 1/07; G08B 5/36; E01C 9/08
USPC ..... 340/907, 854.7, 870.29, 924, 925; 362/382, 384; 345/179
See application file for complete search history.

(56) References Cited

U.S. PATENT DOCUMENTS

| | | | | |
|---|---|---|---|---|
| 9,304,031 | B1 * | 4/2016 | Gupta | G01G 19/44 |
| 2002/0092110 | A1 * | 7/2002 | Blum | A47L 23/22 15/215 |
| 2005/0270175 | A1 | 12/2005 | Peddie et al. | |
| 2006/0012996 | A1 | 1/2006 | Tseng | |
| 2007/0040817 | A1 * | 2/2007 | Underwood | B43K 7/005 345/179 |
| 2007/0050271 | A1 * | 3/2007 | Ufford | G06Q 10/087 705/28 |

* cited by examiner

FOREIGN PATENT DOCUMENTS

| | | |
|---|---|---|
| GB | 2474925 A | 5/2001 |
| GB | 2414973 A | 12/2005 |
| GB | 2478151 A | 8/2011 |

*Primary Examiner* — Tai T Nguyen
(74) *Attorney, Agent, or Firm* — E. Randall Smith; Jones & Smith, LLP

(57) ABSTRACT

Apparatus for providing illumination from a support surface includes a shell releasably engageable with the support surface. An electronics system is seated within the shell and projects light up and out of the shell. A power pack releasably engages the shell and electrically engages the electronics system to provide power thereto. The electrical interface between the electronics system and power pack is fluidly sealed.

19 Claims, 5 Drawing Sheets

110
112
114
117
116
118

110
114
120
112
117
116

128
132
136
132
136
110
110
136
132

94
98
102
95
100
108
106

109
109
102
106
104
94

APPARATUS AND METHODS FOR PROVIDING ILLUMINATED SIGNALS FROM A SUPPORT SURFACE

The present application claims priority to U.S. Provisional Patent Application Ser. No. 61/857,474, filed on Jul. 23, 2013 and entitled "Apparatus and Methods for Providing Illuminated Signals from a Support Surface", which is hereby incorporated herein in its entirety.

FIELD OF THE DISCLOSURE

The present disclosure relates to providing illuminating signals from support surfaces.

BACKGROUND

Temporary or semi-permanent support surfaces have been used for roadways, remote jobsites, industrial staging areas and the like, in an ever-increasing myriad of industries, such as the construction, military, oilfield, transportation, disaster response, utilities and entertainment arenas. These support surfaces are often made up of heavy duty, durable, all-weather, thermoplastic mats, which are reusable and interlock together to form the support surface.

In various scenarios, it may be beneficial to provide one or more illuminated signals from the support surface. For example, in some scenarios, it may be desirable to signal a driver or other equipment operator who is entering, exiting or located upon the support surface. For another example, there may be instances when it is desirable to signal other personnel on or near the support surface. The signal can have any desired purpose, such as indicating a path, boundary or environmental condition.

It should be understood that the above-described discussion is provided for illustrative purposes only and is not intended to limit the scope or subject matter of the appended claims or those of any related patent application or patent. Thus, none of the appended claims or claims of any related application or patent should be limited by the above discussion or construed to address, include or exclude each or any of the above-cited features or disadvantages merely because of the mention thereof herein.

Accordingly, there exists a need for improved systems, articles and methods useful for providing illuminated signals from a support surface having one or more of the attributes or capabilities described or shown in, or as may be apparent from, the other portions of this patent.

BRIEF SUMMARY OF THE DISCLOSURE

In some embodiments, the present disclosure involves apparatus for providing illumination from a load-supporting surface that includes at least one mat. The apparatus includes a shell releasably engageable with the mat. The shell includes a transparent upper surface, a fluid-sealed cavity and a power connection interface therein. An electronics system is configured to be disposed within the cavity of the shell and project light out of the shell through the upper surface of the shell. The electronics system includes at least one electrical connector arranged and adapted to be aligned with the power connection interface of the shell. A power pack is configured to releasably engage the shell and sealingly engage the power connection interface thereof. The power pack has at least one electrical connector arranged and adapted to be aligned with the power connection interface of the shell and electrically couple to the electrical connector of the electronics system to provide electric power thereto. A fluid tight seal is provided around the respective engaged electrical connectors.

In many embodiments, the present disclosure involves a system for providing illumination from a load-supporting surface. The system includes a plurality of portable illuminators releasably engageable with the load-supporting surface at different locations and a network coordinator. Each illuminator includes a fluid-sealed cavity therein and a wirelessly-controlled electronics system disposed within the cavity. The electronics system is configured to project light out of its respective illuminator. Each illuminator also includes a power pack for providing electrical power to the electronics system. The network coordinator is configured to wirelessly communicate with the illuminators to selectively control and vary the color, intensity and/or duration of light projected from each illuminator.

Accordingly, the present disclosure includes features and advantages which are believed to enable it to advance support surface technology. Characteristics and advantages of the present disclosure described above and additional features and benefits will be readily apparent to those skilled in the art upon consideration of the following detailed description of various embodiments and referring to the accompanying drawings.

BRIEF DESCRIPTION OF THE DRAWINGS

The following figures are part of the present specification, included to demonstrate certain aspects of various embodiments of this disclosure and referenced in the detailed description herein.

DETAILED DESCRIPTION OF PREFERRED EMBODIMENTS

Figure 1:
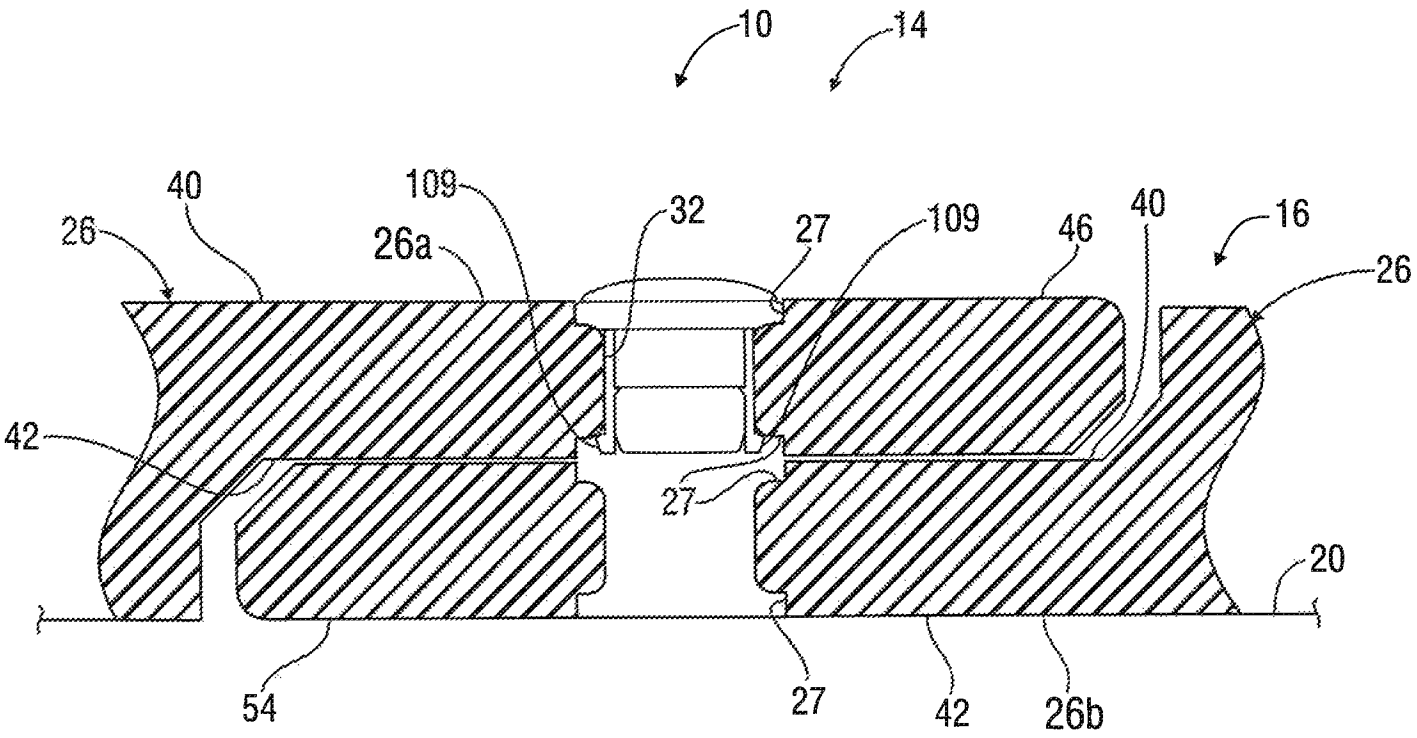
FIG. 1 is a partial cross-sectional view of an embodiment of an illuminator in accordance with the present disclosure engaged with the upper mat of a pair of exemplary overlapping mats in a load-supporting surface.

Characteristics and advantages of the present disclosure and additional features and benefits will be readily apparent to those skilled in the art upon consideration of the following detailed description of exemplary embodiments of the present disclosure and referring to the accompanying figures. It should be understood that the description herein and appended drawings, being of example embodiments, are not intended to limit the claims of this patent or any patent or patent application claiming priority hereto. On the contrary, the intention is to cover all modifications, equivalents and alternatives falling within the spirit and scope of the claims. Many changes may be made to the particular embodiments and details disclosed herein without departing from such spirit and scope.

In showing and describing preferred embodiments in the appended figures, common or similar elements are referenced with like or identical reference numerals or are apparent from the figures and/or the description herein. The figures are not necessarily to scale and certain features and certain views of the figures may be shown exaggerated in scale or in schematic in the interest of clarity and conciseness.

As used herein and throughout various portions (and headings) of this patent application, the terms "invention", "present invention" and variations thereof are not intended to mean every possible embodiment encompassed by this disclosure or any particular claim(s). Thus, the subject matter of each such reference should not be considered as necessary for, or part of, every embodiment hereof or of any particular claim(s) merely because of such reference. The terms "coupled", "connected", "engaged" and the like, and variations thereof, as used herein and in the appended claims are intended to mean either an indirect or direct connection or engagement. Thus, if a first device couples to a second device, that connection may be through a direct connection, or through an indirect connection via other devices and connections.

Certain terms are used herein and in the appended claims to refer to particular components. As one skilled in the art will appreciate, different persons may refer to a component by different names. This document does not intend to distinguish between components that differ in name but not function. Also, the terms "including" and "comprising" are used herein and in the appended claims in an open-ended fashion, and thus should be interpreted to mean "including, but not limited to . . . . " Further, reference herein and in the appended claims to components and aspects in a singular tense does not necessarily limit the present disclosure or appended claims to only one such component or aspect, but should be interpreted generally to mean one or more, as may be suitable and desirable in each particular instance.

Referring to FIG. 1, an embodiment of an illuminator 10 in accordance with the present disclosure is shown engaged with an exemplary load-supporting surface 16. The illustrated load-supporting surface 16 is shown having adjacent mats 26 disposed upon the ground 20 or other surface or area. In this example, the load-supporting surface 16 is reusable and may be capable of supporting the weight of vehicles, equipment and/or other structures thereupon. The illustrated load-supporting surface 16 includes at least two interconnected adjacent mats 26.

Figure 2:
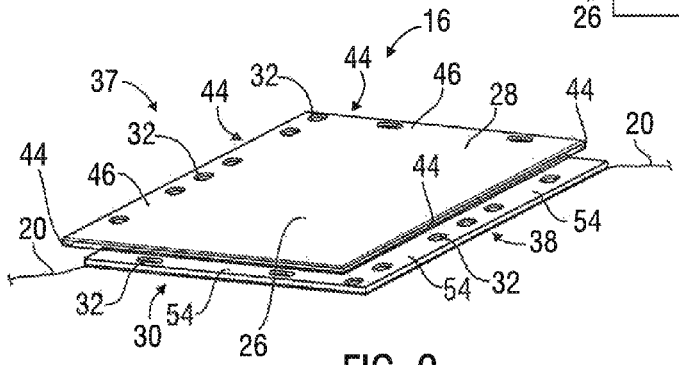
FIG. 2 is a perspective view of the exemplary mat of FIG. 1.

Referring to FIG. 2, the mats 26 may have any suitable form, construction and configuration. Some examples of mats 26 which may be used in various embodiments of the present disclosure are shown and described in U.S. Pat. No. 5,653,551 to Seaux, entitled "Mat System for Construction of Roadways and Support Surfaces" and issued on Aug. 5, 1997, and U.S. Pat. No. 6,511,257 to Seaux et al., entitled "Interlocking Mat System for Construction of Load Supporting Surfaces" and issued on Jan. 28, 2003, both of which have a common Assignee as the present patent application and the entire contents of which are hereby incorporated by reference herein in their entireties. For example, the mats 26 may be 14'×8' DURA-BASE® mats currently sold by the Assignee of this patent application. The illustrated mats 26 are durable thermoplastic mats, such as the DURA-BASE® mats current sold by Applicant and useful, for example, as temporary roads, jobsites and staging areas. However, the present disclosure and appended claims are not limited to this type of mat. As used herein and in the appended claims, the terms "mat" and variations thereof include boards, mats, sheets, plates or other-shaped members desired to be connected together and constructed of any suitable material.

Referring to FIG. 2, in the illustrated embodiment, each mat 26 is flat, or planar, and constructed of impermeable material, such as thermoplastic. The exemplary mat 26 has a rectangular shape with an opposing pair of short sides 28, 30, an opposing pair of long sides 37, 38, and an edge 44 extending along each side 28, 30, 37 and 38. In this particular example, the first short side 28 and first long side 37 each have an upper lip 46 extending horizontally outwardly therefrom, forming the edge 44 and which will be typically spaced above the ground 20 or other surface. The second short side 30 and second long side 38 each have a lower lip 54 extending horizontally outwardly therefrom below the edge 44 thereof and which will typically rest on the ground 20 or other surface. The upper and lower lips 46, 54 may have any suitable size, shape, configuration and length.

Figure 3:
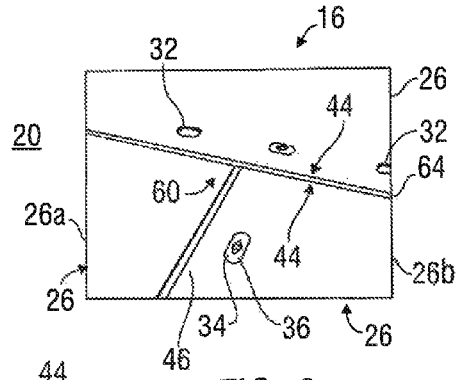
FIG. 3 is a top view of a series of three exemplary interconnected mats.
Figure 4:
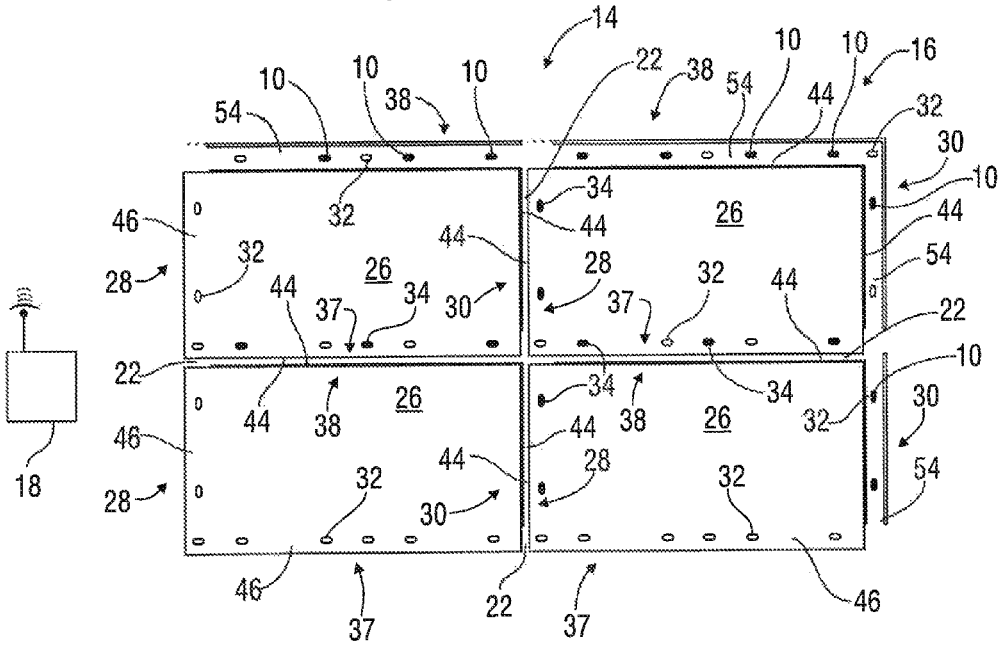
FIG. 4 is a top view of an embodiment of an illumination system including multiple exemplary illuminators in accordance with the present disclosure shown used with a series of four exemplary interconnected mats.

Still referring to FIG. 2, in this example, the respective upper and lower lips 46, 54 of different mats 26 are interconnectable with locking pins 34 (e.g. FIG. 3) releasably securable through corresponding locking pin holes 32 formed therein. The locking pin holes 32 and locking pins 34 may have any suitable form, construction and configuration. The illustrated locking pin 34 is useful to connect, or secure together, at least first (upper) and second (lower) overlapping mats 26*a*, 26*b* (e.g. FIG. 3). In this embodiment, the illustrated mats 26 include a plurality of locking pin holes 32. The exemplary locking pin holes 32 have an oval-shape. Each illustrated mat 26 may include, for example, a total of sixteen locking pin holes 32, eight holes 32 formed in each of the upper and lower lips 46, 54. In some embodiments, the locking pins 34 may form a fluid-tight seal around, or in, the locking pin holes 32 within which they are engaged. Some examples of locking pins 34 which may be used in various embodiments of the present disclosure are shown and described in U.S. Pat. No. 6,722,831 to Rogers et al, entitled "Fastening Device" and issued on Apr. 20, 2004, U.S. Provisional Patent Application Ser. No. 61/748,818, entitled "Apparatus and Methods for Connecting Mats" and filed on Jan. 14, 2013, and U.S. patent application Ser. No. 13/780, 350, entitled "Apparatus and Methods for Connecting Mats" and filed on Feb. 28, 2013, all of which have a common Assignee as the present patent application and the entire contents of which are hereby incorporated by reference herein in their entireties. In the example of FIG. 4, the load-supporting surface 16 includes four overlapping mats 26 interconnected with locking pins 34 and having gaps 22 formed between their respective adjacent edges 44.

Referring back to the example of FIG. 1, an indentation 27 is formed in the upper and lower surfaces 40, 42 of the respective upper and lower lips 46, 54 of each illustrated mat 26 around each locking pin hole 32. In this embodiment, the indentation 27 formed in the upper lips 46 of the mats 26 is also oval and configured to seat an oval-shaped enlarged head 36 (e.g. FIG. 3) of the illustrated locking pin 34.

It should be noted, however, that the illuminator 10 of the present disclosure is not limited to use with the above-described or referenced types and configurations of load-supporting surfaces 16, mats 26, locking pins 34 and locking pin holes 32, or to the disclosures of the above-referenced patents and patent applications. Any suitable load-supporting surfaces 16, mats 26, locking pins 34 and locking pin holes 32 may be used. Moreover, the illuminator 10 may be used with load-supporting surfaces 16 not having mats 26, locking pins 34 or locking pin holes 32. Thus, the illuminator 10 of the present disclosure may be used with any type of support surface having any desired components and is not limited thereby, unless and only to the extent as may be explicitly required in a particular claim hereof and only for such claim and any claims depending therefrom.

Now in accordance with the present disclosure, referring back to FIG. 1, the illuminator 10 is arranged and adapted to be illuminated, or provide an illuminated signal, in connection with the load-supporting surface 16. If desired, the illuminator 10 may be part of an illumination system 14 that includes multiple illuminators 10 and control equipment relating thereto.

The illuminator 10 may have any suitable form, configuration and operation and may be associated with the load-supporting surface 16 in any suitable manner. In this embodiment, each illuminator 10 is configured to be inserted into a locking pin hole 32 of one of the mats 26. For example, the exemplary illuminator 10 may be friction fit or snapped into the hole 32 of one mat 26 (or the upper mat 26 of a set of overlapping mats). In other embodiments, the illuminator 10 may be insertable into and extend at least partially through the corresponding aligned holes 32 of two overlapping mats 26. However, the present disclosure is not limited to these particular arrangements. The illuminator 10 may be affixed to or associated with the load-supporting surface 16 in any other desired manner. For example, each illuminator 10 may be secured (via clip, connector, adhesive, etc.) to the side, top or other aspect of the load-supporting surface 16 or a component thereof. For another example, the illuminator 10 may be integral to, or formed as part of, the load-supporting surface 16 or a component thereof.

Figure 5:
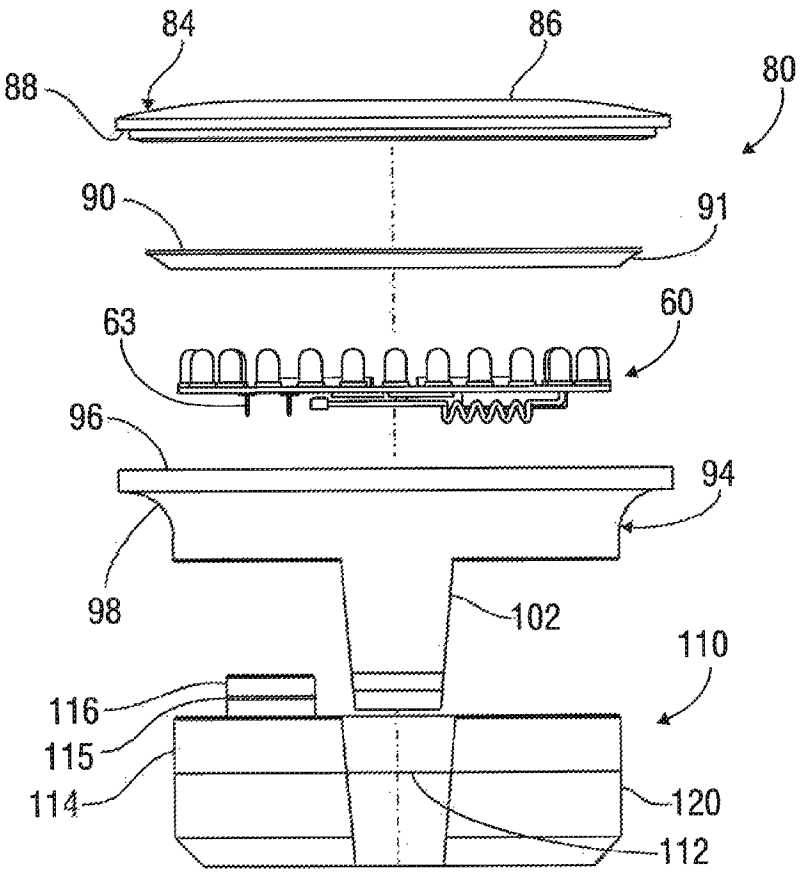
FIG. 5 is an assembly drawing of the exemplary illuminator shown in FIG. 1.

In the embodiment of FIG. 5, the illuminator 10 includes an electronics system 60 that provides illumination, a housing 80 that carriers and protects the electronics system 60 and directs light from the electronics system 60 and a power pack 110 that supplies power to the electronics system 60. The electronics system 60, housing 80 and power pack 110 may have any suitable form, configuration and operation.

Figure 16:
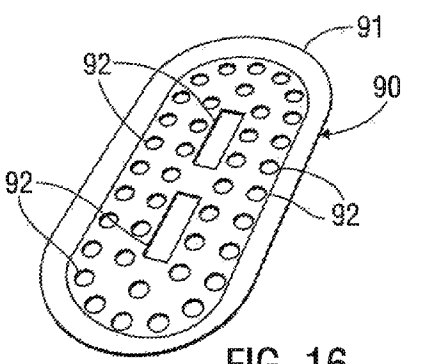
FIG. 16 is a perspective view of the exemplary reflector shown in FIG. 5.

Still referring to FIG. 5, the illustrated housing 80 includes a lens 84, reflector 90 and shell 94. The exemplary lens 84 and reflector 90 overlay the electronics system 60, which is housed in the shell 94. In this embodiment, the reflector 90 is arranged and adapted to direct light from the illuminator 10 as desired. The reflector 90 may have any suitable, form, configuration and operation and may be constructed of any suitable material. If molded from plastic, for example, the reflector 90 may be electroplated to provide sufficient reflectivity. The illustrated reflector 90 (e.g. FIG. 16) includes an angled ridge 91 around its perimeter and a series of cut-outs 92 to be aligned over, and allow the passage of light to or from, various illuminating or light receiving components of the electronics system 60, such as described further below. The reflector 90 may, if desired, be configured to reflect heat away from the electronics system 60 in high temperature environments.

The exemplary lens 84 is configured to assist in protecting the electronics system 60 from forces applied to the illuminator 10 from above. It may have any suitable form, configuration and operation and may be constructed of any suitable material. In many embodiments, the lens 84 may be designed with sufficient strength and other specifications to withstand loading from rolling vehicles and equipment, dropped tools and other load-bearing events and hazards occurring on the load-supporting surface 16 (e.g. FIG. 1), as well as environmental factors, such as temperature, rain, snow, etc. If desired, the lens 84 may be sufficiently scratch resistant to avoid damage thereto during typical or expected use scenarios. For example, the lens 84 may be constructed of transparent thermoplastic material.

The lens 84 may be configured to assist the reflector 90 in directing light out of the illuminator 10. For example, the lens 84 may have an optical design for promoting effective illumination, especially if the illuminator 10 is used during daytime hours. In this embodiment, the lens 84 includes a face 86 having a curved shape to allow the desired light projecting angles from the illuminator 10 and enhance the load-withstanding capacity of the lens 84.

Still referring to FIG. 5, the exemplary lens 84 is configured to sealing engage the shell 94, such as to prevent the entry of liquids therein. In this example, the lens 84 includes a lip 88 extending around the perimeter thereof and which sealingly engages an upper perimeter edge 96 of the shell 94. If desired, one or more suitable adhesive or sealant may be included at the interface between the lip 88 and edge 96. In some embodiments, the lens 84 and shell 94 may be welded to provide a sealed housing 80.

The exemplary shell 94 isolates and protects the electronics system 60 and its electrical connection to the power pack 110. The shell 94 may have any suitable form, configuration and operation. In this example, the shell 94 includes an interior cavity 95 (e.g. FIG. 8) within which the electronics system 60 securely seats and a hard, fluid-resistant wall 98 for encapsulating the electronics system 60. The shell 94 may be constructed of any suitable material or combination of materials to withstand the expected forces, environmental factors and other variables acting on it and the load-supporting surface 16. For example, the shell 94 may be constructed of thermoplastic material by injection molding.

Referring back to FIG. 1, the exemplary shell 94 releasably engages the locking pin hole 32 of the mat 26 in any suitable manner. In this embodiment, the shell 94 includes a pair of spaced-apart legs 102, 104 extending downwardly therefrom and each having at least one outwardly extending protrusion 109 (see also FIG. 9) configured to engage the underside indentation 27 formed in the mat 26 below the locking pin hole 32. In this example, the legs 102, 104 bend sufficiently to allow a snap-fit of the protrusions 109 in the indentation 27 to securely engage the illuminator 10 to the mat 26.

Figure 6:
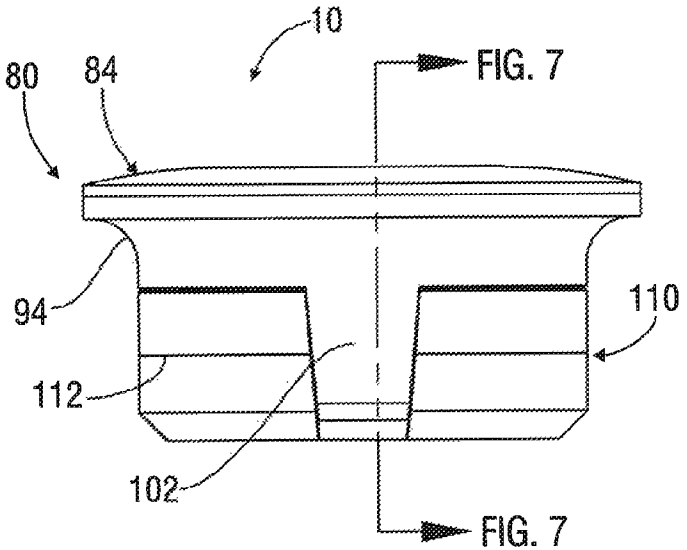
FIG. 6 is a side view of the exemplary illuminator shown in FIG. 5.
Figure 7:
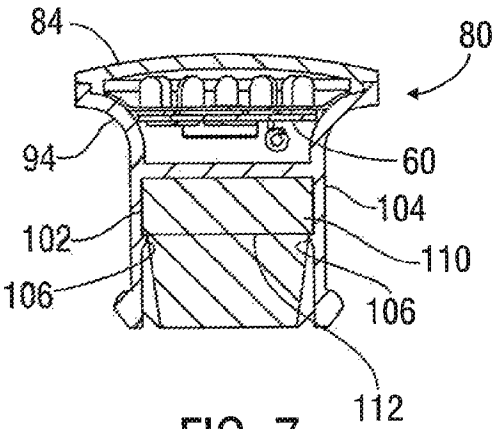
FIG. 7 is a cross-sectional view of exemplary illuminator of FIG. 6 taken along lines 6-6.

Referring now to FIGS. 6 & 7, the illustrated shell 94 releasably engages the exemplary power pack 110 and secures its connection with the electronics system 60. For example, the legs 102, 104 of the shell 94 may be configured to engage or grip the power pack 110. In this embodiment, each leg 102, 104 includes an inwardly facing ledge 106 that grips a ridge 112 (e.g. FIG. 5) on the outside of the power pack 110. In this example, the ridge 112 is an outer edge of the power pack 110. The power pack 110 may be releasably engageable with the shell 94 for ease of replacement and/or maintenance or any other desired purpose. In the present embodiment, for example, the snap-in design allows different types of power packs 110 to be used with the electronics system 60.

It should be noted, however, in other embodiments, the power pack 110 may not be releasably engageable with the shell 94. For example, the power pack 110 and shell may 94 be part of the same component. For another example, the power pack 110 may be integral to (or a part of) the shell 94. One example embodiment would be a one-time use illuminator 10, wherein the entire device can be replaced or has a limited battery recharge capability (e.g. solar assisted).

Figures 8, 9, 10, 11, 12:
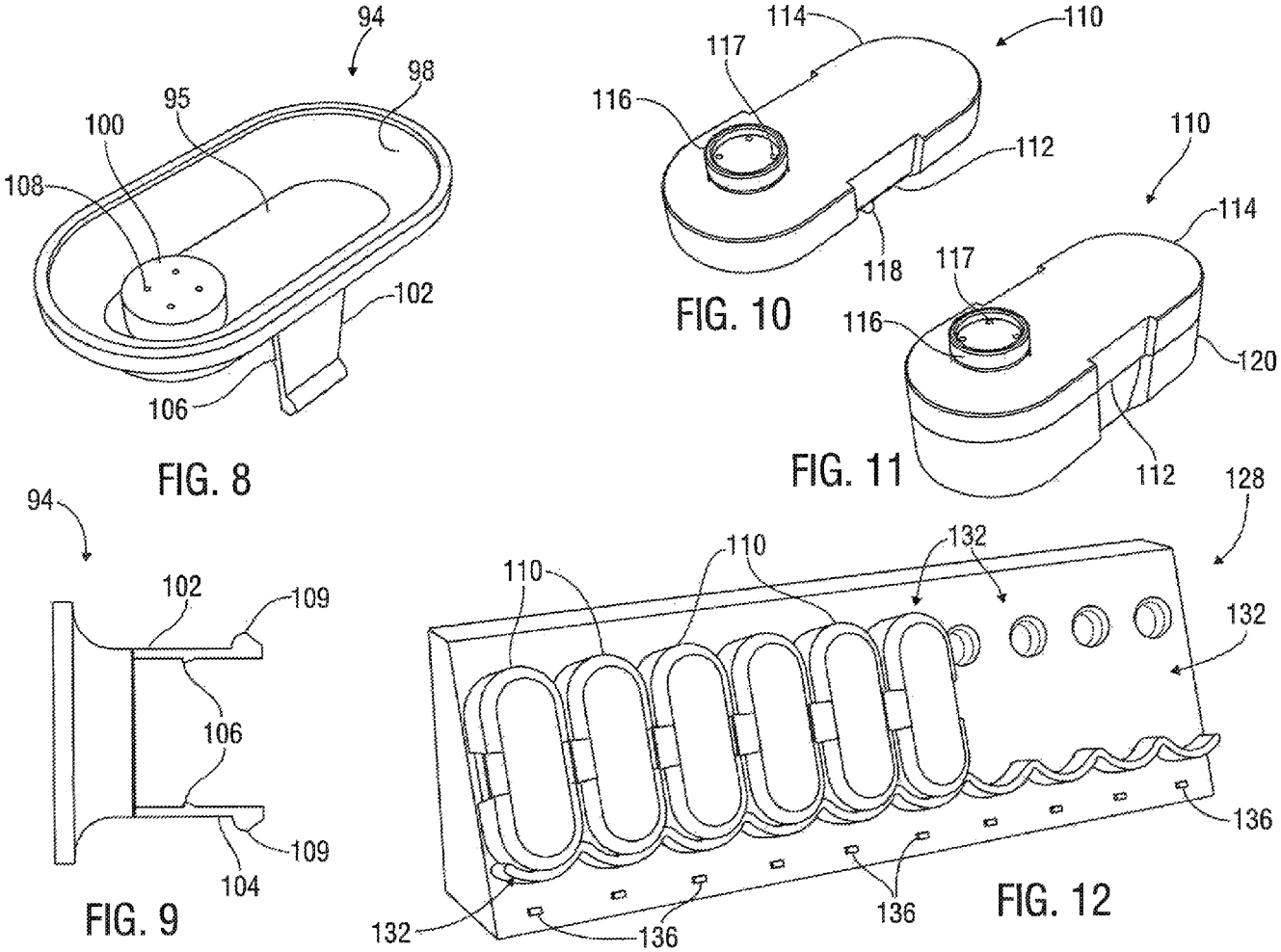
FIG. 8 is a perspective view of the shell portion of the exemplary illuminator of FIG. 5.
FIG. 9 is an end view of the shell portion of the exemplary illuminator of FIG. 8.
FIG. 10 is a perspective view of an embodiment of a power pack useful in the exemplary illuminator of FIG. 5.
FIG. 11 is a perspective view of another embodiment of a power pack useful in the exemplary illuminator of FIG. 5.
FIG. 12 is a perspective view of an exemplary battery charging system.

Referring to FIGS. 8 & 9, in this embodiment, the exemplary shell 94 includes a power connection interface 100 within the cavity 95 for facilitating, isolating and/or protecting the electrical connection between the electronics system 60 and power pack 110. The power connection interface 100 may have any suitable form, configuration, operation and construction. For example, the power connection interface 100 may be insert-molded. In this example, the power connection interface 100 has multiple (e.g. four) holes 108 that accept multiple (e.g. four) power adapter pins 63 (e.g. FIG. 5) of the electronics system 60 and align them for engagement with corresponding socket holes 117 (e.g. FIGS. 10 & 11) in the adapter 114 of the power pack 110.

Figure 13:
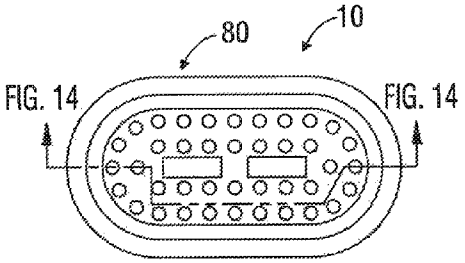
FIG. 13 is a top view of the exemplary illuminator of FIG. 5.
Figure 14:
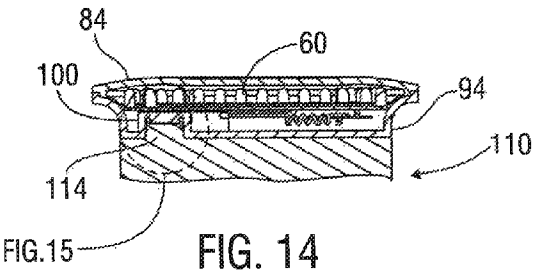
FIG. 14 is a cross-sectional view of the exemplary illuminator of FIG. 13 taken along lines 14-14.
Figure 15:
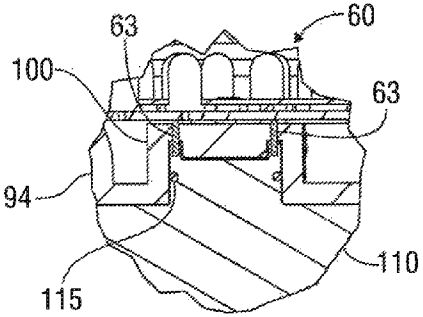
FIG. 15 is an exploded view of part of the exemplary illuminator of FIG. 14.

Referring now to FIG. 10, the power pack 110 may have any suitable form, configuration and operation sufficient to provide the necessary power supply to the exemplary electronics system 60. The illustrated power pack 110 includes an adapter 114 for providing power to the electronics system 60. The exemplary adapter 114 includes an electrical connector 116 for electrical connection with the electronics system 60. For example, the electrical connector 116 may include multiple (e.g. four) socket holes 117. In this embodiment, as shown in FIGS. 13-15, the connector 116 sealingly engages the power connection interface 100 of the shell 94 to assist in providing a fluid tight seal around its engagement with the electrical connector 62 or power adapter pins 63 of the electronics system 60. For example, one or more O-ring seals 115 may extend around the connector 116 to sealingly engage the interface 100. However, the power pack 110 may provide power to the electronics system 60 in any other suitable manner.

In some embodiments, the power pack 110 may include a cord 118 connectable with an external power source, such as a local power grid (not shown). The use of a corded power pack 110 to receive direct external power may be beneficial in various circumstances, such as for long term and/or continuous use of the illuminator 10. A corded-version of the power pack 110 may require power conversion electronics (not shown) to meet device input requirements, as are and become further known in the industry.

Now referring to FIG. 11, the power pack 110 may instead, or also, be battery-powered. For example, the power pack 110 may include one or more batteries 120 that are releasably engageable with a battery housing, or adapter 114, such as by snap-fitting. Any suitable type and configuration of battery 120 may be incorporated into the power pack 110. The battery specifications may depend upon the requirements of the electronics system 60, as are and become further known in the art. The use a battery-powered power pack 110 may be useful, for example, in remote areas where a corded power source is not available or feasible. Some embodiments of the power pack 110 may have both battery powering capability and a corded option for powering the power pack 110 and, if desired, for recharging the battery.

In some embodiments, the battery 120 may be rechargeable, as is and becomes further known. If desired, referring to the embodiment of FIG. 12, a battery charging system 128 may be used. The charging system 128 may have any suitable form, configuration and operation. In FIG. 12, an exemplary charging system 128 is connectable to an external power source (not shown) and useful for charging a multitude of batteries 120. The illustrated system 128 may, for example, be wall or table mounted, or have its own support structure, and be designed to accommodate a large volume of batteries 120. The illustrated charging system 128, for example, includes ten battery charging stations 132. The system 128 may control all aspects of the charging cycle and indicate the condition of the battery 110 at each station 132. In this example, a status indicator 136 is provided at each station 132.

Figure 17:
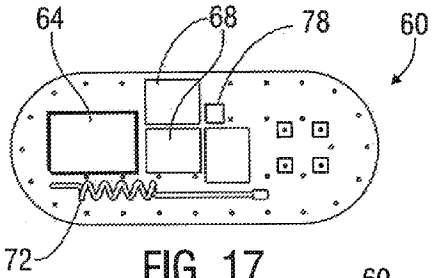
FIG. 17 is a bottom view of the exemplary electronics system shown in FIG. 5.
Figure 18:
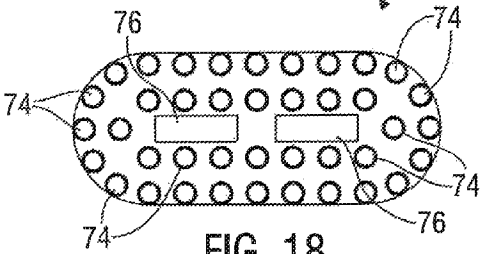
FIG. 18 is a top view of the exemplary electronics system shown in FIG. 5.

The electronics system 60 may have any suitable form, configuration and operation sufficient to provide the desired illumination from the illuminator 10. Referring to FIGS. 17 & 18, the exemplary electronics system 60 is wirelessly controlled to provide light having a selected brightness and color scheme for a selected duration and/or sequence. In this embodiment, the electronics system 60 includes an RF module 64, one or more LED drivers 68, an antenna 72 and multiple LED units 74.

The illustrated LED units 74 provide the light source for the illuminator 10. If desired, each LED unit 74 may include multiple individual LED lights, such as to provide different colors of light. For example, each LED unit 74 may include individual red, green and blue LED lights to be able to provide a wide spectrum of different colors (including white). The exemplary LED drivers 68 are used to regulate current to the LED units 74. For example, the LED drivers 68 may be configured to boost battery power voltage to power large LED units 74, protect the LED lights from being destroyed by current surge and ensure consistent performance of the LED lights at varying battery charge levels. If desired, brightness of the LED lights may be controlled by pulse width modulation.

Still referring to FIGS. 17 & 18, the illustrated RF module 64 includes a wireless transceiver and microcontroller. The exemplary microcontroller interprets messages received by the transceiver and generates control signals for the LED drivers 68. In this embodiment, the exemplary antenna 72 is used by the transceiver of the RF module 64 to receive messages. In some embodiments, the antenna 72 may also be used by the transceiver to transmit messages. The transmit and receive capabilities of the electronics system 60 may be used to support a network of illuminators 10 in the illumination system 12.

Figure 19:
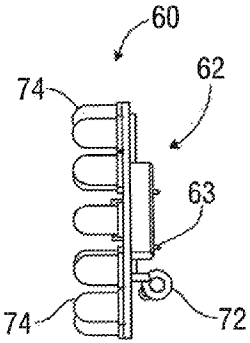
FIG. 19 is a side view of the exemplary electronics system shown in FIG. 5.

In this embodiment, the electronics system 60 also includes an electrical connector 62 (e.g. FIG. 19) for electrical connection to the power pack 110. The illustrated electrical connector 62 includes multiple (e.g. four) power adapter pins 63 extending downwardly from the system 60 for engagement with the shell 94 and power pack 110. In this example, the pins 63 receive energy from the power pack 110 during operation of the illuminator 10. If desired, the electronics system 60 may include one or more solar panels 76 (e.g. FIG. 18) to capture energy from sunlight during daytime hours and provide it to the illuminator 10. For example, the solar panels 76 may be used to supplement power to the electronics system 60 during operations and/or provide a charge to one or more battery 120 (e.g. FIG. 11) in the power pack 110. If necessary or desired, a charger circuit 78 may be included in the electronics system 60 to convert energy captured by the solar panels 76 into safe and useful energy. When solar panels 76 are included, the electrical connector 62 of the electronics systems 60 may, if desired, be used to deliver the captured energy from the solar panels 76 to the power pack 110.

The present embodiment of the illuminator 10 is assembled in a stacked arrangement and requires minimal labor for assembly. Various embodiments of the illuminator 10 are stand-alone, self-contained, portable and reusable. The exemplary illuminator 10 is designed to withstand harsh environmental conditions and industrial environments. For example, the illuminator 10 may be designed to support loads from rolling vehicles and other equipment, function across a wide range of ambient temperatures and weather conditions, and survive contact with oil and grease, submersion in water, extended ultraviolet light exposure and impact.

An exemplary illumination system 14 (e.g. FIG. 4) includes a plurality of illuminators 10 deployable at different desired locations in the load-supporting surface 16 and at least one network coordinator 18. In this embodiment, the network coordinator 18 can be an on-site or off-site computer or other wireless device that wirelessly communicates with and remotely controls the illuminators 10. If desired, the communication protocol used in the network may be selected to support standard data encryption techniques for network security and use 2.4 GHX ISM bandwith for global interoperability.

Each exemplary illuminator 10 is a portable illuminated marker that can be used to serve as a node in a secure wireless mesh network of illuminators 10. A variety of types of signals may be provided, such as, for example, by on/off sequencing or switching, lighting sequencing, color changes or light intensity changes of one or more illuminator 10. The illuminator 10 or system 14 may be used in any desired application. For example, the illuminator 10 or system 14 may be useful to signal an observer to indicate a path, boundary, environmental condition, etc. Other exemplary potential applications include perimeter markings, illuminated road lines, zone designation within a workspace, identification of dangerous areas, crew changes, alarm signals, etc. The illumination system 14 may, if desired, be a wireless mesh network of illuminators 10 that integrates wireless sensing, monitoring and alarm systems. Thus, the types of uses and applications of the illuminator 10 and illumination system 14 are not limiting upon the present disclosure.

As mentioned above, the exemplary illuminators 10 are useful with DURA-BASE® mats, which are durable thermoplastic mats currently sold by Applicant and useful, for example, as temporary roads, jobsites and staging areas. However, the illuminator 10 is not limited to use with DURA-BASE® mats, but may be used with any suitable mats, boards, sheets, plates or other-shaped members that are part of, connected to or associated with a support surface. Likewise, the illuminator 10 is not limited to use in the pin holes of DURA-BASE® mats, but may be used in any other suitable holes or orifices of any suitable support surface, or may be otherwise connected to, or associated with, any suitable support surface.

If desired, the illuminator 10 and/or illumination system 14 may be used in conjunction with technology shown and disclosed in any combination of U.S. patent application Ser. No. 13/790,916, entitled "Liquid Containment System for Use With Load-Supporting Surfaces" and filed on Mar. 8, 2013, U.S. Provisional Patent Application Ser. No. 61/888,580, entitled "Apparatus & Methods for Electrically Grounding a Load-Supporting Surfaces" and filed on Oct. 9, 2013, and U.S. Provisional Patent Application Ser. No. 61/889,171 filed on Oct. 10, 2013 and entitled "Apparatus & Methods for Sealing Around the Opening to an Underground Borehole", all of which has a common Assignee as the present application and the entire contents of which are hereby incorporated by reference herein.

Preferred embodiments of the present disclosure thus offer advantages over the prior art and are well adapted to carry out one or more of the objects of this disclosure. However, the present invention does not require each of the components and acts described above and is in no way limited to the above-described embodiments or methods of operation. Any one or more of the above components, features and processes may be employed in any suitable configuration without inclusion of other such components, features and processes. Moreover, the present invention includes additional features, capabilities, functions, methods, uses and applications that have not been specifically addressed herein but are, or will become, apparent from the description herein, the appended drawings and claims.

The methods that may be described above or claimed herein and any other methods which may fall within the scope of the appended claims can be performed in any desired suitable order and are not necessarily limited to any sequence described herein or as may be listed in the appended claims. Further, the methods of the present invention do not necessarily require use of the particular embodiments shown and described herein, but are equally applicable with any other suitable structure, form and configuration of components.

While exemplary embodiments of the invention have been shown and described, many variations, modifications and/or changes of the system, apparatus and methods of the present invention, such as in the components, details of construction and operation, arrangement of parts and/or methods of use, are possible, contemplated by the patent applicant(s), within the scope of the appended claims, and may be made and used by one of ordinary skill in the art without departing from the spirit or teachings of the invention and scope of appended claims. Thus, all matter herein set forth or shown in the accompanying drawings should be interpreted as illustrative, and the scope of the disclosure and the appended claims should not be limited to the embodiments described and shown herein.

The invention claimed is:

1. Apparatus for providing illumination from a load-supporting surface, the load-supporting surface, including at least one mat, the apparatus comprising:

a shell releasably engageable with the mat, said shell having a transparent upper surface, a fluid-sealed cavity and a power connection interface therein;

an electronics system disposed within said cavity of said shell and configured to project light out of said shell through said upper surface of said shell, said electronics system having at least one electrical connector arranged and adapted to align with said power connection interface of said shell; and a power pack configured to releasably engage said shell and sealingly engage said power connection interface thereof, said power pack having at least one electrical connector arranged and adapted to align with said power connection interface of said shell and electrically couple to said electrical connector of said electronics system to provide electric power to said electronics system, wherein a fluid tight seal is provided around said respective engaged electrical connectors.

2. The apparatus of claim 1 wherein the mat includes at least one locking pin hole, further wherein said shell is releasably engageable within a locking pin hole of the mat.

3. The apparatus of claim 2 wherein said shell includes at least two legs extending downwardly therefrom and configured to engage the mat when said shell is disposed in a locking pin hole thereof.

4. The apparatus of claim 3 wherein each said leg includes at least one protrusion extending outwardly therefrom, each said protrusion configured to engage the mat.

5. The apparatus of claim 4 wherein each said leg includes at least one ledge extending inwardly therefrom, each said ledge configured to releasably engage said power pack.

6. The apparatus of claim 1 wherein said shell includes a transparent lens sealingly engaged across the upper surface thereof.

7. The apparatus of claim 6 further including at least one reflector disposed within said shell over said electronics system and arranged and adapted to direct light from said electronic system out of said shell through said lens.

8. The apparatus of claim 7 wherein said power pack is engaged with said shell below said electronics system, further wherein said power pack, electronics system, reflector, lens and shell are assembled in a stacked arrangement.

9. The apparatus of claim 1 wherein said electronics system is wirelessly controlled.

10. The apparatus of claim 9 wherein said electronics system is selectively controlled to vary the color, intensity and duration of light projecting therefrom.

11. The apparatus of claim 9 wherein said electronics system includes at least one RF module, LED driver and antenna and multiple LED units.

12. The apparatus of claim 11 wherein each said LED unit includes multiple individual LED lights.

13. The apparatus of claim 11 wherein said RF module includes a wireless transceiver and microcontroller, said transceiver configured to send and receive wireless messages and said microcontroller configured to interpret received messages and generate control signals for said LED driver.

14. The apparatus of claim 9 wherein said electronics system further includes at least one solar panel configured to capture energy from sunlight during daytime hours to provide an electrical charge to said power pack.

15. The apparatus of claim 1 wherein said power pack includes at least one battery.

16. The apparatus of claim 15 wherein the apparatus for providing illumination from a load-supporting surface is self-contained, stand alone, portable and reusable.

17. The apparatus of claim 15 further including a charging system configured to charge multiple said batteries.

18. The apparatus of claim 1 wherein said power pack includes a cord for electrical connection to an external power source.

19. The apparatus of claim 1 wherein said shell is configured to withstand harsh environmental conditions, impact and loads from rolling vehicles and other equipment thereon, contact with oil and grease, submersion in water and extended ultraviolet light exposure.

* * * * *